US006572234B1

(12) United States Patent
Maier et al.

(10) Patent No.: US 6,572,234 B1
(45) Date of Patent: Jun. 3, 2003

(54) LAMP, ESPECIALLY A SURGERY LAMP, WITH AT LEAST TWO BULBS

(75) Inventors: Stefan Maier, Weiterstadt (DE); Sören Wasow, Freigericht (DE)

(73) Assignee: Heraeus Med GmbH, Hanau (DE)

( * ) Notice: Subject to any disclaimer, the term of this patent is extended or adjusted under 35 U.S.C. 154(b) by 161 days.

(21) Appl. No.: 09/678,005

(22) Filed: Oct. 3, 2000

(30) Foreign Application Priority Data

Nov. 23, 1999 (DE) ..... 199 56 337

(51) Int. Cl.[7] ..... F21V 19/04

(52) U.S. Cl. ..... 362/20; 362/302; 362/304; 362/804

(58) Field of Search ..... 313/111, 113, 313/114, 115; 362/227, 235, 236, 237, 241, 247, 33, 804, 20, 207, 304, 302, 298, 13, 14

(56) References Cited

U.S. PATENT DOCUMENTS 4,451,873 A * 5/1984 Tyler et al. ..... 362/267
4,587,601 A * 5/1986 Collins ..... 362/235
4,755,916 A * 7/1988 Collins ..... 362/236
5,951,139 A * 9/1999 Smith et al. ..... 362/33
6,339,279 B1 * 1/2002 Miyamoto et al. ..... 313/113

FOREIGN PATENT DOCUMENTS

DE 9311156.8 10/1993

* cited by examiner

*Primary Examiner*—Robert H. Kim
*Assistant Examiner*—Jurie Yun
(74) *Attorney, Agent, or Firm*—Fulbright & Jaworski L.L.P.

(57) ABSTRACT

To achieve great security against failure in lamps for medical applications, especially lamps for surgery, two electric bulbs are placed each in a concave mirror of ellipsoidal shape as part of a reflector, the two concave mirrors having focal points which are aligned with one another along an optical axis. The concave mirror provided to serve as the main lamp is configured as a ring reflector, while the concave mirror designed to operate as a reserve lamp closes off the reflector on the side facing away from the direction of emergence of the light. Thus, in the event of a change from main lamp operation to reserve lamp operation, the illuminated field is maintained at least approximately in its size and the location does not change (X and Y directions).

11 Claims, 3 Drawing Sheets

LAMP, ESPECIALLY A SURGERY LAMP, WITH AT LEAST TWO BULBS

Figure 1:
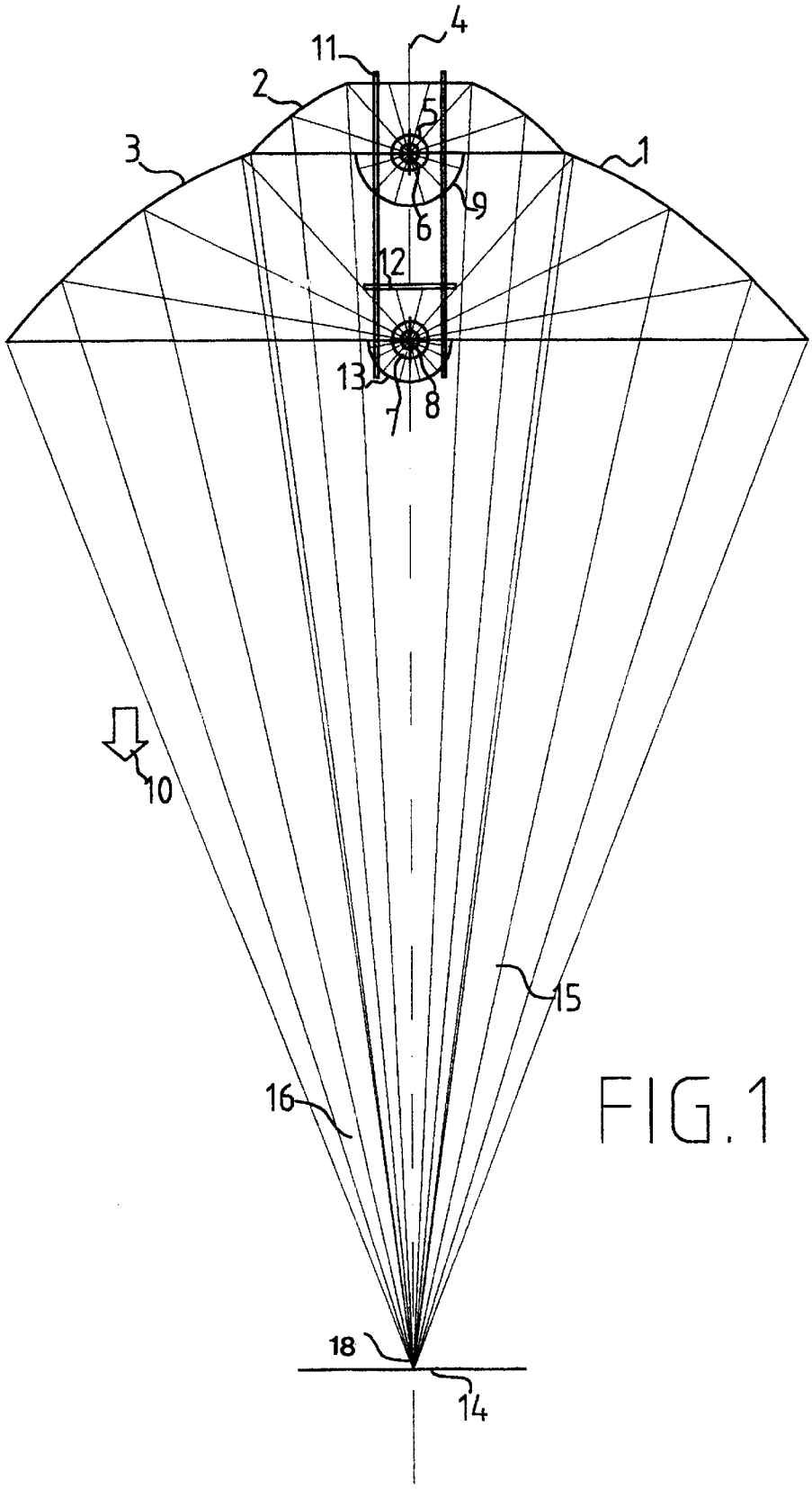

The invention relates to a lamp, especially a surgery lamp, with at least two electrical bulbs which can be positioned at the focal point of at least one concave mirror serving as reflector.

In German Gebrauchsmuster G 93 11 156.8 there is disclosed an apparatus for the positioning on alternate sides of at least two bulbs in a predetermined position, especially in a focal point of a lamp having a concave mirror, the bulbs being disposed on an apparatus bearing a bistable mechanical position memory. The apparatus can be shifted automatically upon receiving a signal (bulb failure), whereupon a first bulb is brought away from the focal point and a second bulb is moved into the focal point, circuitry producing the movement being associated with the apparatus.

Even though in this case, when a first bulb as the main bulb fails, an equally strong additional illumination without lateral shifting of the cone of light is made possible by a second bulb as a reserve bulb, the changeover requires a controlling signal which, on the basis of the shifting mechanism, does not bring about a changeover to the reserve bulb without a certain delay. The result is an at least slight time-delay during some operation, which should be prevented if possible (the action of the anaesthetic decreases). In addition, there is possible wear due to natural movement, so that constant inspection of the positioning mechanism is necessary.

The problem for the invention is to offer a lamp with great security against failure, in which a changeover in the event of bulb failure is possible without delay and without substantial variation of the field of illumination; furthermore, it is also to be possible to obtain an elevated brightness by the use of two lamps operated in parallel.

The problem is solved by the invention in that at least two concave mirrors are disposed along a common optical axis with a common direction of light emission, at least one of which is configured as a ring reflector, the concave mirrors having focal points spaced apart from one another on the optical axis, at each of which one bulb is situated as a light producing means.

Advantageous embodiments of the subject of the invention are given in claims 2 to 12.

What proves advantageous, in addition to fast changeover (short changeover duration) is a relatively low liability to phenomena of wear; furthermore, no damage is done to the illuminator by any accidental movement. Thus, in the case of use over long periods little expense is to be expected, since no mechanical wear of any kind takes place.

In a preferred embodiment of the invention the concave mirrors are made substantially axially symmetrical.

Advantageously, at least two concave mirrors form a single common reflector, while at least one concave mirror, configured as a ring reflector, has a central opening which is closed by at least one concave mirror disposed concentrically therein. The use of a one-piece reflector proves especially advantageous. Preferably both concave mirrors of the common reflector are configured each as part of an ellipsoid in which one bulb is used as a light source in a first focal point. The second focal point of the concave mirror configured as a partial ellipsoid is situated at least approximately within the field of illumination. The lamps situated each at different focal points can be switched on individually and independently (i.e., separately from one another).

Preferably both bulbs, seen in the direction of the emission of the light, are provided each with a concave counter-reflector which reflects the radiation issuing frontally along the optical axis in back of the filaments toward the hollow mirror. It proves to be advantageous that no direct radiant heat strikes the illuminated field—e.g., the incision produced in the operation on the patient.

In a preferred embodiment of the invention, the reflecting surface of the concave mirror serving as counter-reflector is configured as part of a sphere. The reflecting surface of the concave mirror for the spare lamp can be configured as part of a paraboloid.

The common reflector preferably has a faceted surface on both of the concave mirrors.

Furthermore, the reflecting surface is provided with an interference coating so as to remove any thermal radiation toward the rear of the reflector or of the housing covering it on the back side (i.e., away from the actual illuminated field).

The first bulb serving as the main bulb is disposed on a mounting for displacement along the reflector axis such that its radiation toward the concave mirror of the spare lamp is blocked by a shielding disk between the two bulbs.

A halogen bulb is used with preference as the main lamp, but it is also possible to use a discharge bulb; the second bulb serving as a spare is always in the form of an incandescent or halogen lamp which can be supplied directly from the low-voltage supply main (24 V main) backed by an emergency power supply for operating rooms.

Due to the arrangement of a main bulb and reserve bulb, when a changeover is made, no abrupt change occurs in the illuminated field, such as would be expected with an off-center arrangement of the spare bulb.

The changeover is triggered by a sensor through which the current for the main bulb passes and which in the event of a power interruption produces the switchover by operating a switch means, preferably a relay. A Hall generator is preferably used as the sensor.

The subject matter of the invention is explained hereinafter with the aid of FIGS. 1 and 2*a* and 2*b*.

FIG. 1 shows a lamp in which two bulbs bum simultaneously as light sources.

Figure 2A:
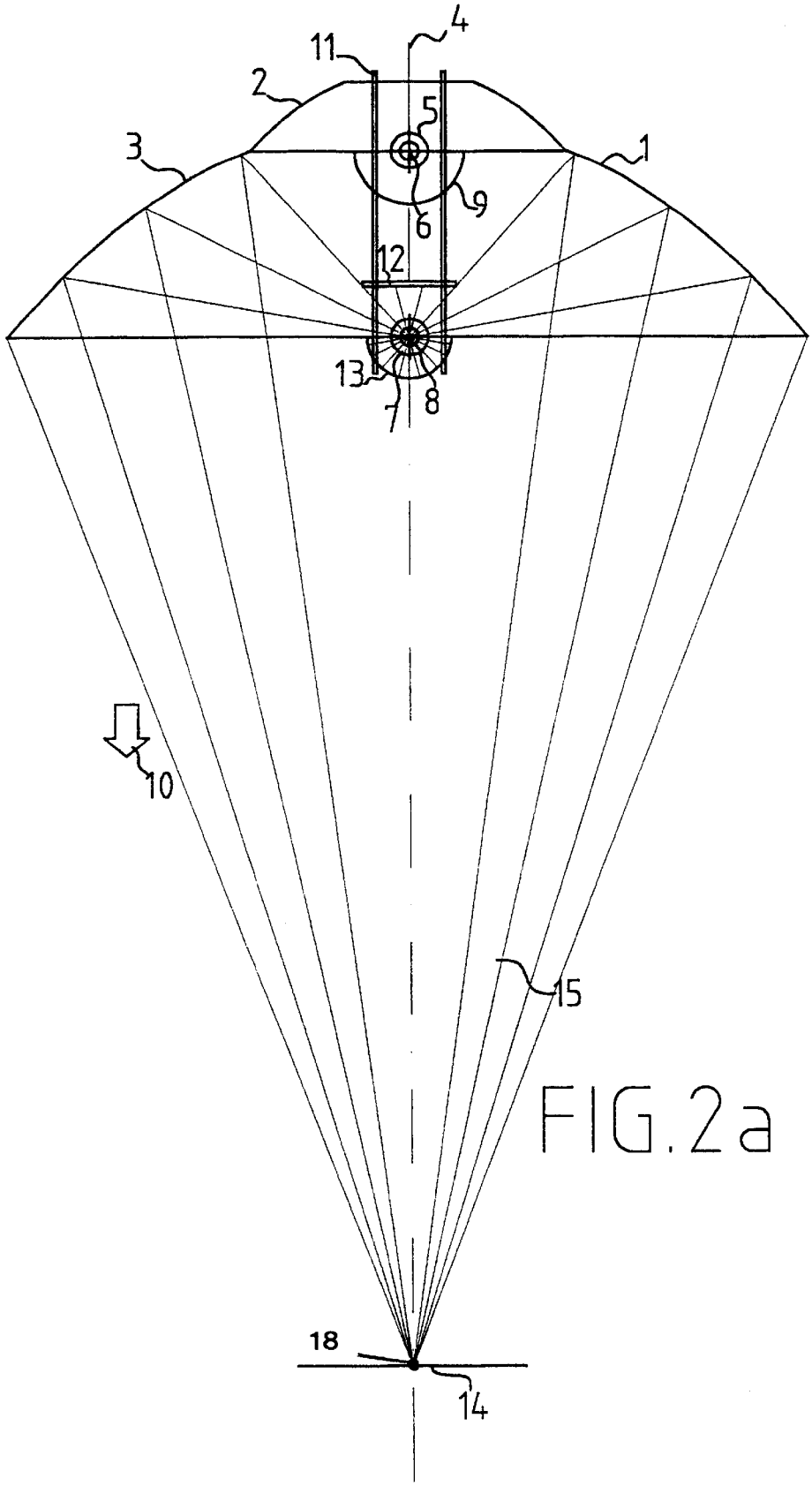
Figure 2B:
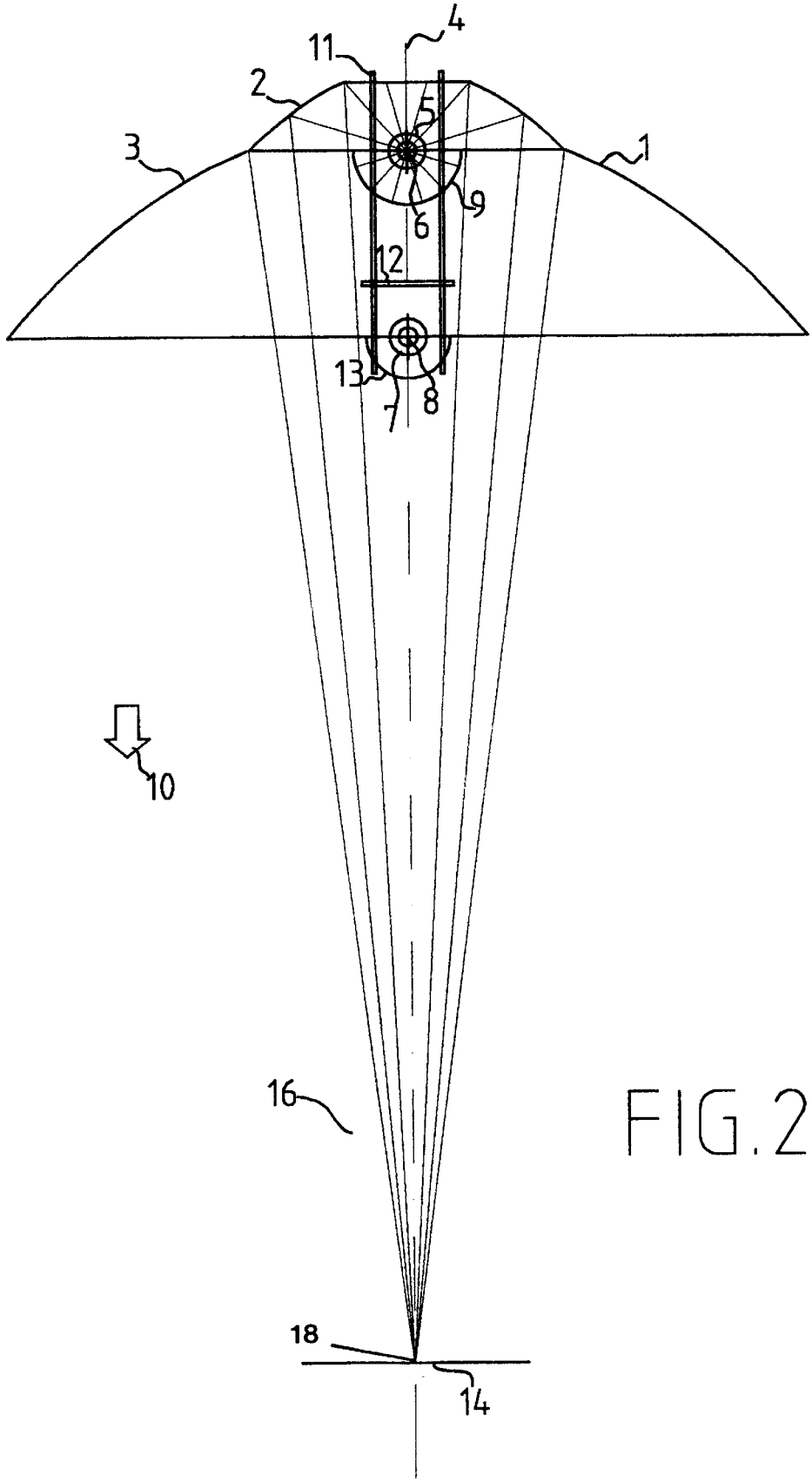

FIG. 2*a* shows first the operation of the lower, first bulb as the main bulb, and FIG. 2*b* shows the subsequent operation of an upper, second bulb in reserve.

According to FIG. 1, the reflector 1 consists of two fixedly joined concave mirrors 2 and 3 as partial ellipsoids which are arranged in axial symmetry along an optical axis 4 and with the same direction of light emission according to arrow 10. The reflector is manufactured from a blank preferably by pressing from sheet aluminum, the surface of which, designed for the reflection, is faceted (single segments). The surface designed for the reflection is provided with an interference filter coating for the purpose of eliminating thermal radiation produced by the back of the reflector. At the focal point 6 of the upper concave mirror 2 there is the bulb 5 serving for reserve lighting, while at the focal point 8 of the lower, ring-shaped concave mirror 3 bulb 7 is positioned. Bulb 7 serves as the main light, while any radiation into the upper concave mirror is prevented by a blocking disk 12 disposed between the two bulbs 5 and 7 in the common, displaceable mounting of both bulbs 5 and 7. Lamps 5 and 7 have each a concave counter-reflector 9 and 13 in the form of a partial hemisphere disposed on the optical axis 4 in the direction indicated by the arrow at 10, by which direct radiation, i.e., including thermal radiation, onto the illuminated field is prevented. In a preferred embodiment, both concave mirrors 2 and 3 are in the form of partial ellipsoids. According to FIG. 1 it is also possible to supply both lamps simultaneously with power, so that light issues along the optical axis 4 in the direction of arrow 10 from both concave mirrors 2 and 3 of the reflector. Thus it is possible to obtain an elevated intensity of light in the field of illumination.

The beam path of FIG. 1 shows that, with two concave mirrors 2 and 3, which as partial ellipsoids have each their second focal point 18 in the center of the field of illumination 14, a different depth of illumination is possible; in that case only the main beam path is represented schematically by rays 15 and 16 from the center of the bulbs. The field size is the result of the natural spread of the light sources and of the diffusing texture used, which here is preferably by the faceting on the reflector. The size of the field of illumination 14 is approximately the same for both reflector systems.

From FIG. 2*a* it can be seen that here—in contrast to FIG. 1—only the bulb 7, designed as the main light, is in operation at focal point 8, while the other bulb (reserve light) is turned off. The exit beam 15 guided by the large ring-shaped concave mirror 3 as part of the entire reflector 1 is concentrated at the second focal point 18 in the plane of the illumination field 14, so that there a good depth of illumination of the surgical incision is possible. The beam issuing from lamp 7 frontally, in the direction of arrow 10, is reflected by the counter-reflector 13, made in the form of a partial hemisphere, to the concave mirror 3, so that despite a comparatively small reflector area a great effectiveness can be achieved.

In the event of failure of bulb 7, by means of a current sensor and a controlled switch or relay the current is switched to bulb 5 at focal point 6 according to FIG. 2*b*, while due to the concave mirror of the reflector disposed in axial symmetry along the optical axis 4 the light intensity and aim remain virtually unchanged, since both concave mirrors 2 and 3 have approximately the same performance in the direction indicated by arrow 10; also when the reserve bulb 5 is in operation the beam issuing frontally in direction 10 is directed by counter-reflector 9 to concave mirror 2, so that, even when operating on the reserve bulb a high reflective power is achieved despite the comparatively small area of concave mirror 2. The beam 16 issuing from concave mirror 2 is likewise concentrated at the second focal point 18 of the field of illumination.

For reserve-bulb operation according to FIG. 2*b*, a halogen incandescent lamp is preferably used as bulb 5, since here a strong supply of power is involved, which depends only on the low-voltage mains in the operating room (24 V).

The changeover to a reserve bulb is indicated by an optical signal, so that the operator or surgeon is informed that a fault has occurred and a changeover has been made. Halogen lamps are used with preference, but it is also possible to use discharge tubes or combination lighting.

What is claimed is:

1. A lamp comprising at least two electric bulbs which can be positioned at the focal point of at least one concave mirror serving as reflector, wherein at least two concave mirrors are disposed along a common optical axis with a common light issuance direction, of which at least one is configured as a ring reflector, the concave mirrors having focal points disposed at a distance apart on the optical axis, in each of which one bulb is disposed as light source, and a changeover device is provided with a current sensor for the operation of the bulb serving as the main lamp, the current sensor being connected to the input of the controllable switch.

2. A lamp according to claim 1, wherein the concave mirrors are substantially axially symmetrical.

3. A lamp according to claim 2, wherein the surface of at least one of the concave mirrors is configured as a portion of an ellipsoid.

4. A lamp according to claim 1, wherein at least two concave mirrors form a common reflector, at least the concave mirror configured as a ring reflector being closed by a concave mirror arranged concentrically with it in the direction opposite the light issuance side.

5. A lamp according to claim 1, wherein the reflector has a faceted surface.

6. A lamp according to claim 1, wherein the reflector is provided with an interference coating to carry away thermal radiation.

7. A lamp according to claim 1, wherein a first lamp serving as principal lamp is blocked off from the reflector for a second bulb as reserve bulb by means of a blocking body.

8. A lamp according to claim 7, characterized in that the reserve bulb is a halogen bulb.

9. A lamp according to claim 1, wherein both bulbs are arranged in a mounting displaceable along the optical axis of the reflector for the purpose of simultaneous focusing.

10. A lamp according to claim 1, wherein at least one of the two concave mirrors of the reflector is provided with a counter-reflector.

11. A lamp according to claim 1, wherein the electric bulbs are switchable individually and independently of one another.

* * * * *